US011341885B2

(12) United States Patent
Yang et al.

(10) Patent No.: US 11,341,885 B2
(45) Date of Patent: May 24, 2022

(54) DISPLAY PANEL, PIXEL CHARGING METHOD, AND COMPUTER READABLE STORAGE MEDIUM

(71) Applicant: HKC CORPORATION LIMITED, Guangdong (CN)

(72) Inventors: Yanna Yang, Guangdong (CN); Zhenli Song, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/044,239

(22) PCT Filed: Dec. 25, 2018

(86) PCT No.: PCT/CN2018/123358
§ 371 (c)(1),
(2) Date: Sep. 30, 2020

(87) PCT Pub. No.: WO2020/107597
PCT Pub. Date: Jun. 4, 2020

(65) Prior Publication Data

US 2021/0150961 A1 May 20, 2021

(30) Foreign Application Priority Data

Nov. 27, 2018 (CN) ..... 201811429900.2

(51) Int. Cl.
*G09G 3/20* (2006.01)

(52) U.S. Cl.
CPC ..... *G09G 3/20* (2013.01); *G09G 2310/0251* (2013.01); *G09G 2310/0267* (2013.01); *G09G 2310/08* (2013.01)

(58) Field of Classification Search
None
See application file for complete search history.

(56) References Cited

U.S. PATENT DOCUMENTS

2017/0004785 A1* 1/2017 Qi ..... G09G 3/3611
2018/0357972 A1* 12/2018 Wang ..... G09G 3/3688

FOREIGN PATENT DOCUMENTS

CN 101127201 A 2/2008
CN 101595517 A 12/2009
CN 103000119 A 3/2013
(Continued)

OTHER PUBLICATIONS

Written Opinion (Form PCT/ISA/237) of Application No. PCT/CN2018/123358; dated Sep. 6, 2019.
(Continued)

*Primary Examiner* — Ifedayo B Iluyomade
(74) *Attorney, Agent, or Firm* — Westbridge IP LLC

(57) ABSTRACT

The present invention provides a pixel charging method, including: a preset charging duration and a current time point are acquired when a first gate integrated circuit is turned on; a precharging period and an actual charging period of a scan line of each target integrated circuit of the thin film transistor substrate are determined based on the preset charging duration and the current time point; thin film transistor switches corresponding to the scan line of each of the target gate integrated circuits are controlled to be turned on during the precharging period and the actual charging period of the scan line.

11 Claims, 4 Drawing Sheets

(56) References Cited

FOREIGN PATENT DOCUMENTS

| | | | |
|---|---|---|---|
| CN | 103165059 | A | 6/2013 |
| CN | 104810001 | A | 7/2015 |
| CN | 104916265 | A | 9/2015 |
| CN | 106920524 | A | 7/2017 |
| CN | 107065366 | A | 8/2017 |
| CN | 107369417 | A | 11/2017 |
| JP | 2004310100 | A | 11/2004 |
| KR | 20080036283 | A | 4/2008 |

OTHER PUBLICATIONS

International Search Report (Form PCT/ISA/210) Application No. PCT/CN2018/123358; dated Sep. 6, 2019.
First Chinese Office Action Application No. 201811429900.2; dated Feb. 25, 2020.
Second Chinese Office Action Application No. 201811429900.2; dated Aug. 28, 2020.

* cited by examiner

DISPLAY PANEL, PIXEL CHARGING METHOD, AND COMPUTER READABLE STORAGE MEDIUM

CROSS-REFERENCE TO RELATED APPLICATIONS

The present disclosure is the National Stage of International Application with No. PCT/CN2018/123358, filed on Dec. 25, 2018, which claims the benefit of Chinese Patent Application with No. 201811429900.2, filed on Nov. 27, 2018 and entitled "Display Panel, Pixel Charging Method, and Computer Readable Storage Medium", the entirety of which is incorporated herein by reference.

FIELD

The present disclosure relates to the field of display device technology, and in particular, to a display panel, a pixel charging method, and a computer readable storage medium.

BACKGROUND

Display panel commonly has a Thin Film Transistor (TFT) array substrate. A plurality of scan lines and a plurality of data lines are arranged on the TFT array substrate. Images are displayed by each sub-pixel receiving scan signal through the scan line, and receiving data signal through the data line, respectively. The data signal is generally transmitted to the source end through the data line from the opposite side of the data source end. Due to an existence of the resistor and capacitor of the data line itself and other loads on the panel, the transmitted data signal is prone to be deformed, which results in the delay of turning-on of the pixel TFT switches corresponding to deformed data signal on the scan line. Since the scan line controlled by each Gate Integrated Circuit (Gate IC) has the same turning-on duration, namely, the preset charging time for each pixel is the same, the delay of turning-on the pixel TFT switches signifies the insufficiently charging of the pixels, which leads to the problem of uneven brightness and low picture quality of the display panel.

SUMMARY

The main purpose of the present disclosure is to provide a display panel, a pixel charging method, and a computer readable storage medium, aiming at solving the problem of uneven brightness and low image quality of the display panel caused by insufficiently charging of the pixels.

To achieve the above purpose, the present disclosure provides a pixel charging method including:

acquiring a preset charging duration and a current time point when detecting that a first Gate IC on a TFT substrate is turned on, and the TFT substrate is provided with a plurality of horizontally arranged scan lines and a plurality of vertically arranged data lines, and taking a scan line having a maximum distance from data transmission ends of the data lines as a target scan line, and taking a Gate IC controlling the target scan line to be turned on as the first Gate IC;

determining an actual charging period of scan lines corresponding to each target Gate IC excluding the first Gate IC on the TFT substrate based on the preset charging duration and the current time point;

determining a precharging period of the scan line corresponding to each of the target Gate ICs; and controlling TFT switches corresponding to the scan line for each of the target Gate ICs to be turned on during the precharging period and the actual charging period, to charge pixels corresponding to the scan lines, and a voltage polarity of each pixel electrode corresponding to the data line on the TFT substrate is the same.

In order to achieve the above purpose, the present disclosure further provides a display panel, including at least one processor, and a memory device, and the memory device stores instructions executable by the at least one processor, and the at least one processor executes the instructions to perform the following operations:

acquiring a preset charging duration and a current time point when detecting that a first Gate IC on a TFT substrate is turned on, and the TFT substrate is provided with a plurality of horizontally arranged scan lines and a plurality of vertically arranged data lines, and taking a scan line having a maximum distance from data transmission ends of the data lines as a target scan line, and taking a Gate IC controlling the target scan line to be turned on as the first Gate IC;

determining an actual charging period of the scan lines corresponding to the first Gate IC based on the current time point and the preset charging duration;

determining the actual charging period of the scan lines corresponding to each of the target Gate ICs based on the actual charging period of the scan line corresponding to the first Gate IC, and actual charging periods of the scan lines corresponding to each of the ICs on the TFT substrate are sequential;

determining a precharging period of the scan line corresponding to each of the target Gate ICs; and controlling TFT switches corresponding to the scan lines for each of the target Gate ICs to be turned on during the precharging period and the actual charging period, to charge pixels corresponding to the scan lines, and a voltage polarity of each pixel electrode corresponding to the data line on the TFT substrate is the same.

To achieve the above purpose, the present disclosure further provides a computer readable storage medium storing computer executable instructions executable by at least one processor, and the at least one processor executes the computer executable instructions to perform following operations:

acquiring a preset charging duration and a current time point when detecting that a first Gate IC on a TFT substrate is turned on, and the TFT substrate is provided with a plurality of horizontally arranged scan lines and a plurality of vertically arranged data lines, and taking a scan line having a maximum distance from data transmission ends of the data lines as a target scan line, and taking a Gate IC controlling the target scan line to be turned on as the first Gate IC;

determining an actual charging period of scan lines corresponding to each target Gate IC excluding the first Gate IC on the TFT substrate based on the preset charging duration and the current time point;

determining a precharging period of the scan line corresponding to each of the target Gate ICs; and controlling TFT switches corresponding to the scan lines for each of the target Gate ICs to be turned on during the precharging period and the actual charging period, to charge pixels corresponding to the scan lines, and a voltage polarity of each pixel electrode corresponding to the data line on the TFT substrate is the same.

According to the display panel, the pixel charging method, and the computer readable storage medium provided by the present disclosure, when the first Gate IC at the opposite side of the Source IC is turned on, the current time point and the preset charging duration are acquired to determine the precharging period and the actual charging period of the scan lines controlled by each of the Gate ICs on the TFT substrate excluding the first Gate IC, so as to control the TFT switches corresponding to the scan line for each of the Gate ICs to be turned on during the precharging period and the actual charging period corresponding to the scan lines. The pixels corresponding to the scan lines are able to be precharged in advance, which ensures that the voltages of the pixels corresponding to the each of the scan lines are able to reach the setting voltage value, thereby the uniformity of the brightness of the display panel is ensured, and the picture quality of the display panel is high.

The implementation, functional features and advantages of the present disclosure will be further described with reference to the accompanying drawings.

DETAILED DESCRIPTION OF THE EMBODIMENTS

It should be understood that, the specific embodiments described herein are merely illustrative of the present disclosure, and are not intended to limit the scope of the present disclosure.

The main solution of the embodiments in the present disclosure is as follows: when a first Gate IC on a TFT substrate is detected to be turned on, a preset charging duration and a current time point are acquired. The TFT substrate is provided with a plurality of horizontally arranged scan lines and a plurality of vertically arranged data lines. A scan line having a maximum distance from data transmission ends of the data lines is taken as a target scan line, so as to take a Gate IC controlling the target scan line to be turned on as the first Gate IC. A precharging period and an actual charging period of a scan line corresponding to each target Gate IC excluding the first Gate IC on the TFT substrate are determined based on the preset charging duration and the current time point. TFT switches corresponding to the scan lines corresponding to each of the target Gate ICs are controlled to be turned on during the precharging period and the actual charging period corresponding to the scan line, so as to charge pixels corresponding to the scan lines. A voltage polarity of each pixel electrode corresponding to the data lines on the TFT substrate is the same.

The pixels corresponding to the scan lines on the display panel are precharged in advance, which ensures that voltages of the pixels corresponding to each of the scan lines are able to reach a set voltage value, thereby the uniformity of the brightness of the display panel is ensured, and the display panel has high picture quality.

Figure 1:
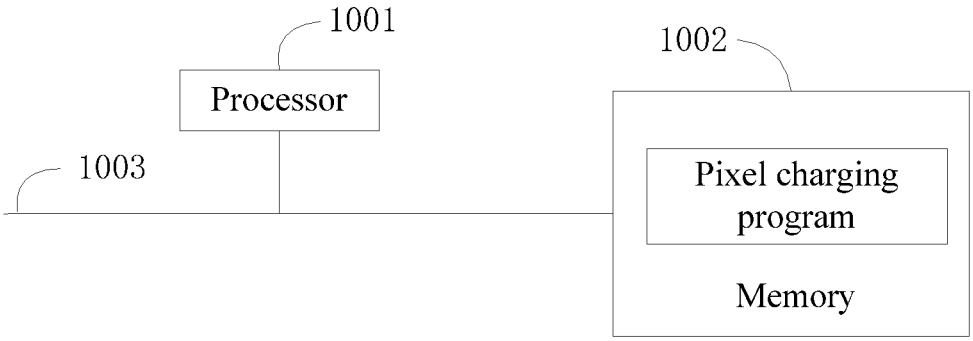
FIG. 1 is a schematic diagram illustrating a hardware structure of a display panel according to some embodiments of the present disclosure.

As an implement solution, the display panel may be as shown in FIG. 1.

The embodiments of the present disclosure relate to a display panel, including a processor 1001 such as a CPU, a memory 1002, and a communication bus 1003 configured to connect and communicate among these components.

The memory 1002 may be a high speed Random Access Memory (RAM) or a Non-Volatile Memory (NVM) such as a disk memory. As shown in FIG. 1, as a computer storage medium, the memory 1003 may include pixel charging programs; and the processor 1001 may be configured to call the pixel charging programs stored in the memory 1002, and perform each operation of the pixel charging method corresponding to the following embodiments.

Embodiments of the pixel charging method of the present disclosure are provided based on the above hardware architecture.

Figure 2:
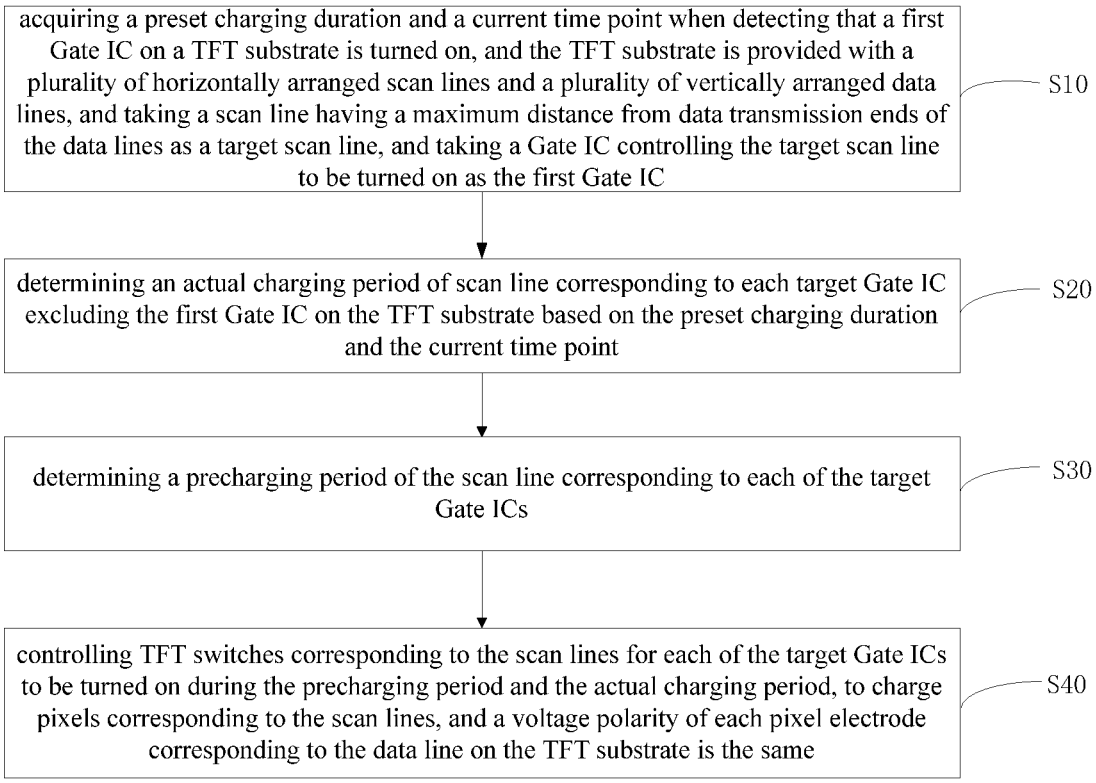
FIG. 2 is a schematic flow chart of a pixel charging method according to an embodiment of the present disclosure.

Referring to FIG. 2, FIG. 2 is an embodiment of the pixel charging method of the present disclosure. The pixel charging method includes following operations:

S10, acquiring a preset charging duration and a current time point when detecting that a first Gate IC on a TFT substrate is turned on, and the TFT substrate is provided with a plurality of horizontally arranged scan lines and a plurality of vertically arranged data lines, and taking a scan line having a maximum distance from data transmission ends of the data lines as a target scan line, and taking a Gate IC controlling the target scan line to be turned on as the first Gate IC.

In the present disclosure, the TFT substrate of the display panel includes a plurality of the scan lines and the data lines. The pixels on the TFT substrate receive scan signals through the scan lines, and receive data signals through the data lines. A voltage polarity of each pixel electrode corresponding to the data lines is the same during charging of the pixels by the same frame of the scan line.

The TFT substrate is provided with a plurality of the Gate ICs, which control scan signals of the scan lines to be turned on and off. The TFT substrate is further provided with a plurality of Source Integrated Circuits (Source ICs), which control data signals of the data lines to be turned on and off. The scan lines are horizontally arranged on the TFT substrate, and the data lines are vertically arranged on the TFT substrate.

During the charging of the pixels of the TFT substrate, the scan lines on the opposite side of the source IC are sequentially turned on to turn on pixel TFTs corresponding to the scan lines, so as to charge the pixels. It can be understood that, the turning-on sequence of each of the Gate ICs on the TFT substrate is: the further away from the Source IC side is, the sooner the corresponding scan line of the Gate IC will be turned on, namely, the further away from the data transmission ends of the data lines is, the sooner the corresponding scan line will be turned on. Turning-on time points and turning-off time points of each of the Gate ICs are sequential.

Since the data signal is transmitted from the opposite side of the Source IC end to the Source IC end through the data line, a resistor and a capacitor of the data line itself and other loads on the display panel may cause a delay of the turning-on of the TFT switches, which leads to an insufficient charging of the pixels. The closer to the Source IC side is, the more severe the delay of the TFT switches are. Based on this, each of the pixels is precharged.

The display panel acquires the preset charging duration and the current time point when detecting that the first Gate IC on the TFT substrate is turned on. The first Gate IC is a Gate IC that is firstly turned on in one frame scan, and is located at the opposite side of the Source IC, namely, the TFT substrate is provided with a plurality of the horizontally arranged scan lines and a plurality of the vertically arranged data lines. The scan line having the maximum distance from the data transmission ends of the data lines is taken as the target scan line, so as to take the Gate IC controlling the target scan line to be turned on as the first Gate IC. The preset charging duration refers to a setting charging duration of the pixels in the display panel.

S20, determining an actual charging period of scan line corresponding to each target Gate IC excluding the first Gate IC on the TFT substrate based on the preset charging duration and the current time point.

S30, determining a precharging period of the scan line corresponding to each of the target Gate ICs.

When the first Gate IC is turned on, the corresponding TFT switches on the scan line controlled by the Gate IC are turn on. Since the data signal firstly enters the pixels corresponding to the scan line controlled by the first Gate IC, the resistor and the capacitor has little effect on the delay of the TFT switches. Therefore, there is no need to precharge the pixels corresponding to the first Gate IC, only to precharge each of the other Gate ICs excluding the first Gate IC. In the present disclosure, each of the other Gate ICs is taken as the target Gate IC.

The actual charging period refers to a charging period originally planned for each of the pixels. The setting period of the scan lines corresponding to each of the Gate ICs are sequential, and the preset charging duration of each of the scan lines is the same, so the actual charging period of the scan lines corresponding to the first target Gate IC may be determined based on the current time point and the preset charging time. The actual charging periods of the scan lines corresponding to each of the Gate ICs are sequential, so the actual charging period of the scan lines corresponding to each of the target Gate ICs may be determined based on the actual charging period of the scan lines corresponding to the first Gate IC. For example, the current time point is 08:30:00, and the preset charging duration is 10 seconds. Then the actual charging period of the scan lines corresponding to the first Gate IC is 08:30:00-08:30:10, and the actual charging period of the scan lines corresponding to the second Gate IC is 08:30:10-08:30:20 (the first and second target Gate ICs are named after the turning-on sequence of the target Gate ICs). And so on, the actual charging period of the scan lines controlled by each of the Gate ICs is acquired.

Each of the target Gate ICs excluding the first Gate IC needs to be precharged, namely, each of the target Gate ICs is provided with a precharging period, and an ending time point of the precharging period corresponding to the target Gate IC is earlier than or is the same as a starting time point of the actual charging period of the target Gate IC. Since the insufficient charging of the pixels are caused by the delay of the pixel TFT switches, a precharging duration corresponding to the precharging period shall be acquired by determining a duration corresponding to a maximum delay of the pixel TFT switches, and the precharging duration of the precharging period corresponding to each of the target Gate ICs may be the duration corresponding to the maximum delay of the pixel TFT switches.

In addition, the duration corresponding to the precharging period may be determined based on the turning-on sequence number of the target Gate IC on the TFT substrate, and the higher the turning-on sequence number is, the longer the duration is. In addition, the precharging period may be integrated with the actual charging period, namely, the ending time point of the target precharging period coincides with the starting time point of the actual charging period.

Certainly, a delay duration of TFT switches corresponding to a scan line with the last turning-on sequence number may be determined to be taken as a precharging duration corresponding to a precharging period of each of the scan lines. Then a starting time point of the actual charging period of each of the scan lines is determined to be taken as an ending time point of the precharging period corresponding to the scan lines, thereby the precharging period is determined.

S40, controlling TFT switches corresponding to the scan lines for each of the target Gate ICs to be turned on during the precharging period and the actual charging period, to charge pixels corresponding to the scan lines, and a voltage polarity of each pixel electrode corresponding to the data line on the TFT substrate is the same;

After determining the precharging period and the actual charging period of the scan lines corresponding to each of the target Gate ICs, the TFT switches corresponding to the scan lines of each of the target Gate ICs may be controlled to be turned on during the precharging period and the actual charging period corresponding to the scan lines to charge the pixels.

In addition, one of the Gate ICs is able to control a plurality of the scan lines, and the precharging durations corresponding to the precharging periods of the plurality of the scan lines controlled by the same Gate IC are the same.

In the technical solution provided by this embodiment, when the first Gate IC at the opposite side of the Source IC on the TFT substrate is turned on, the current time point and the preset charging duration are acquired to determine the precharging period and the actual charging period of the scan lines controlled by each of the Gate ICs on the TFT substrate excluding the first Gate IC, so as to control the TFT switches corresponding to the scan lines of each of the Gate ICs to be turned on during the precharging period and the actual charging period corresponding to the scan lines. The pixels corresponding to the scan lines are precharged in advance, which ensures that the voltages of the pixels corresponding to the each of the scan lines are able to reach the setting voltage value, thereby the uniformity of the brightness of the display panel is ensured, and the picture quality of the display panel is high.

Figure 3:
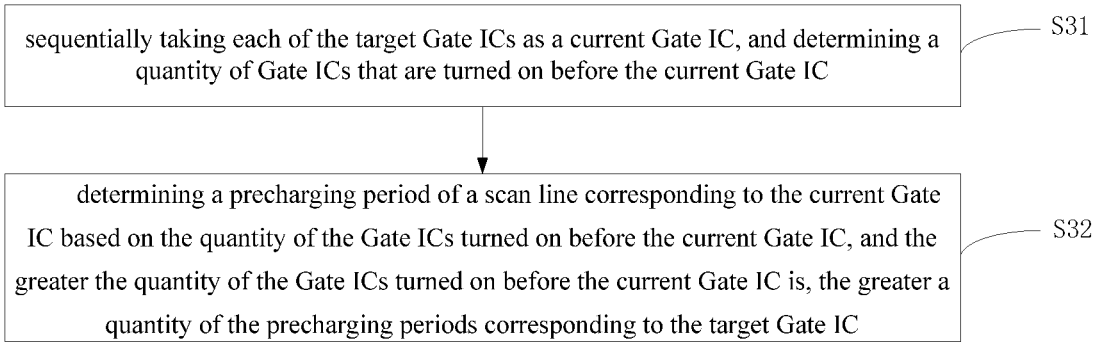
FIG. 3 is a schematic flow chart of the pixel charging method according to another embodiment of the present disclosure.

Referring to FIG. 3, FIG. 3 is another embodiment of the pixel charging method of the present disclosure. According to an embodiment, the S30 includes:

S31, sequentially taking each of the target Gate ICs as a current Gate IC, and determining a quantity of Gate ICs that are turned on before the current Gate IC;

S32, determining a precharging period of a scan line corresponding to the current Gate IC based on the quantity of the Gate ICs turned on before the current Gate IC, and the greater the quantity of the Gate ICs turned on before the current Gate IC is, the greater a quantity of the precharging periods corresponding to the target Gate IC;

Measuring the delay duration of the TFT switches requires additional hardware, which shall inevitably increase the cost of the display panel. During charging of the pixels, the closer the gate IC to the data transmission ends of the data lines is, the more insufficient charging of the pixels controlled by the corresponding scan line is. Regarding this, a precharging duration may be configured to characterize a precharging period, and the closer the Gate IC to the data transmission ends is, the more quantity of the precharging period of the corresponding scan line is.

Turning-on each of the Gate ICs on the TFT substrate is carried out in sequence from the opposite side of the Source IC to the Source IC end. Therefore, the distance between the scan line controlled by the current Gate IC and the data transmission ends of the data lines may be characterized by the quantity of the Gate ICs turned on before the current Gate IC, and the more the quantity is, the closer the scan line corresponding to the current Gate IC to the data transmission ends of the data lines is. It can be understood that, each of the precharging periods of the scan line corresponding to the current Gate IC may be determined by the quantity of the Gate ICs turned on before the current Gate IC of the display panel.

It should be noted that, the precharging duration corresponding to the precharging period may be any suitable value, as long as the starting time point of each of the precharging periods corresponding to the current Gate IC is later than the turning-on time point of the first Gate IC. Further, the precharging duration corresponding to the precharging period may be less than the charging duration of the actual charging period.

In the technical solution provided by this embodiment, each of the target Gate ICs is sequentially taken as the current Gate IC of the display panel, so as to determine the quantity of the Gate ICs turned on before the current Gate IC. Then each of the precharging periods of the scan lines corresponding to the current Gate IC is determined based on the quantity, so as to avoid the detection of the delay duration of the pixel TFT switches, thereby the cost of the display panel is reduced while the uniformity of the display screen is ensured.

Figure 4:
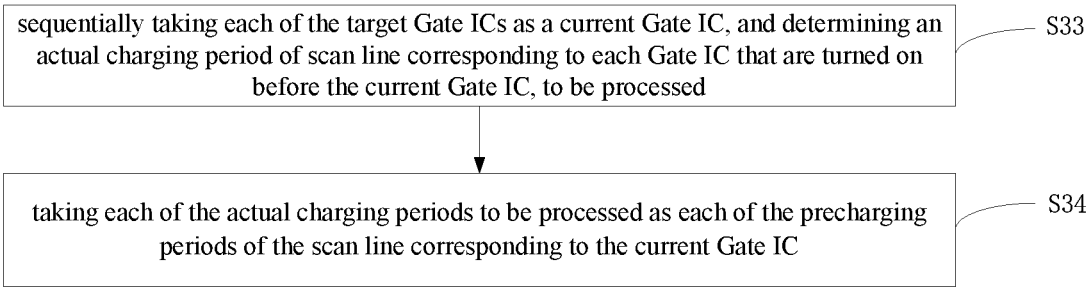
FIG. 4 is a schematic flow chart of the pixel charging method according to still another embodiment of the present disclosure.

Referring to FIG. 4, FIG. 4 is another embodiment of the pixel charging method of the present disclosure. Based on an embodiment, the S30 includes:

S33, sequentially taking each of the target Gate ICs as a current Gate IC, and determining an actual charging period of scan line corresponding to each Gate IC that are turned on before the current Gate IC, to be processed;

S34, taking each of the actual charging periods to be processed as each of the precharging periods of the scan line corresponding to the current Gate IC.

In an embodiment, the precharging period of the target Gate IC is determined based on the actual charging period corresponding to the target Gate IC. While in this embodiment, the precharging period of the target Gate IC is determined based on the actual charging period of each of the Gate ICs.

Specifically, after determining the actual charging periods of each target Gate ICs and the first Gate IC, each of the target Gate ICs is sequentially taken as the current Gate IC, and then the actual charging period of the scan line corresponding to each of the Gate ICs turned on before the current Gate IC is determined, so as to take these actual charging periods as the actual charging period to be processed, which may be taken as the precharging period of the current Gate IC.

Specifically, the precharging duration may be determined based on these actual charging time period to be processed. The precharging duration is a duration corresponding to the precharging period. For example, there are two actual charging durations to be processed, and each of the actual charging durations is 10 seconds, then the precharging duration is 20 seconds, so that the precharging period is determined based on the turning-on time point of the current Gate IC and the precharging duration, and the ending time point of the precharging period is the starting time point of the actual charging period of the current Gate IC.

Certainly, a plurality of precharging periods may be integrated into one precharging period.

The display panel may sequentially acquire the precharging period of each of the target Gate ICs based on the above process.

Further, one of the Gate ICs controls a plurality of the scan lines. In this case, the precharging period corresponding to each of the scan line may refer to the following operations:

A. determining a setting turning-on sequence number of each of the scan lines corresponding to the first Gate IC and each of the target Gate ICs;

B. sequentially taking each of the target Gate ICs as a current Gate IC, and determining an actual charging period of each scan line corresponding to each Gate IC that are turned on before the current Gate IC, to be processed;

C. taking each of the actual charging periods to be processed with the same setting turning-on sequence number as each of the precharging periods of the scan line with the same setting turn-on sequence number of the current Gate IC.

The starting time point and the ending time point of the actual charging period of each of the scan line of the same Gate IC are sequential, namely, each of the scan lines has a corresponding turning-on sequence number.

Figure 5A:
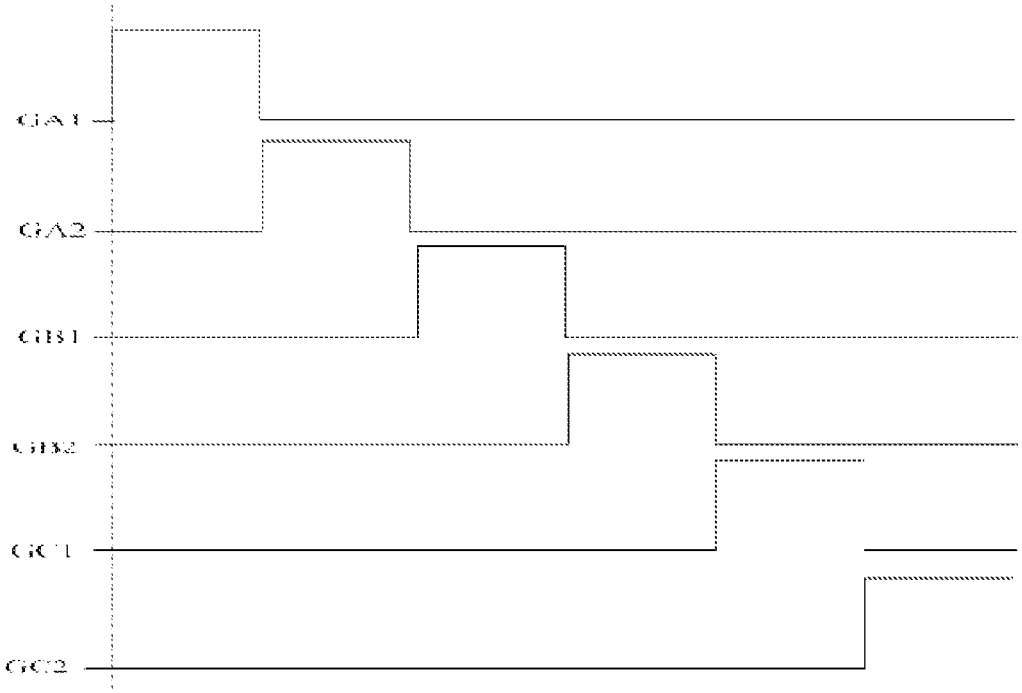
FIG. 5A is a schematic diagram of pixel charging according to an exemplary embodiment.
Figure 5B:
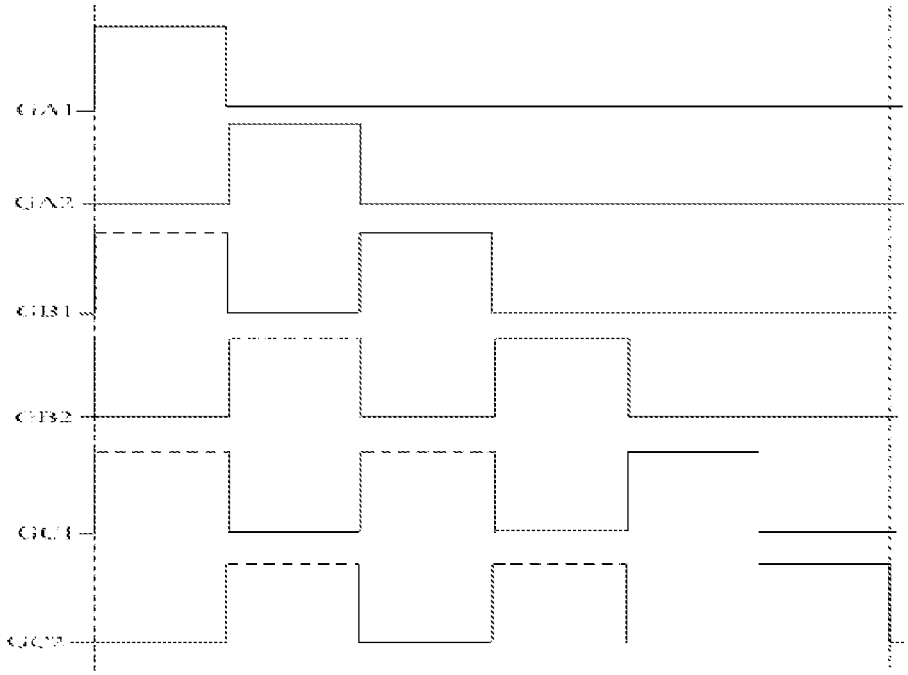
FIG. 5B is a schematic diagram of pixel charging according to another embodiment of the present disclosure.
Figure 5C:
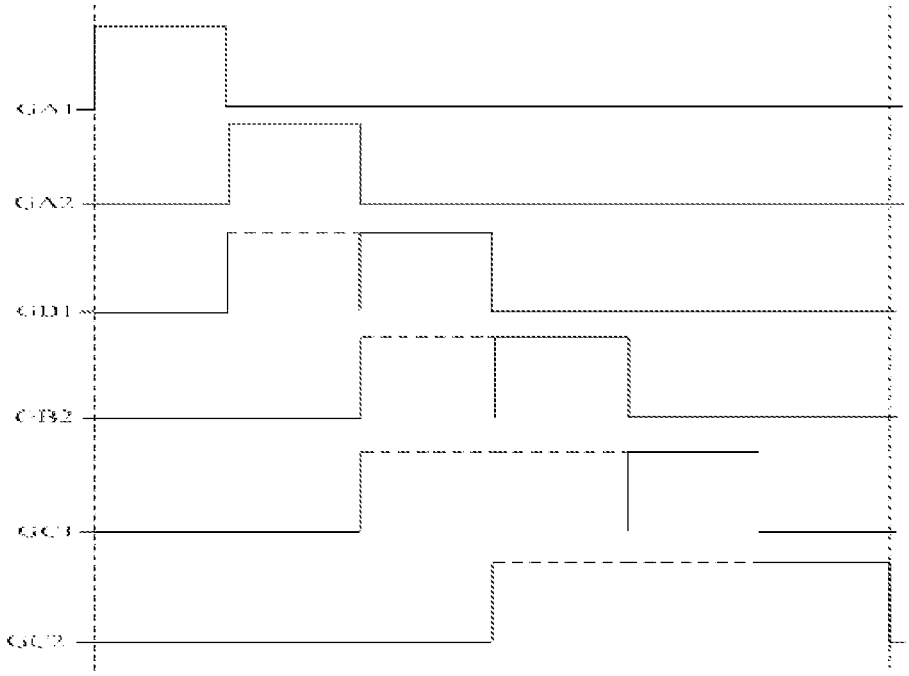
FIG. 5C is a schematic diagram of pixel charging according to still another embodiment of the present disclosure.

Referring to FIG. 5A, FIG. 5B and FIG. 5C, GA, GB, and GC are Gate ICs. GA is the first Gate IC, and each of the Gate ICs controls two of the scan lines (e.g. GA1 and GA2 are the scan lines controlled by the first Gate IC). The Gate ICs in FIG. 5A to FIG. 5C are only provided as some examples, and do not limit that the TFT substrate in the present disclosure has only three Gate ICs, and do not limit that one of the Gate IC controls two of the scan lines. FIG. 5A is a schematic diagram of a pixel charging in another exemplary embodiment, and a signal fluctuation segment is an actual charging period corresponding to a scan line. In addition, in FIG. 5B and FIG. 5C, high levels represented by dashed lines are the precharging periods, and high levels represented by solid lines are the actual charging periods.

FIG. 5B is a schematic diagram of pixel charging in the third embodiment of the present disclosure. Specifically, the actual charging period of the scan line controlled by each of the Gate ICs turned on before the Gate IC is determined (the determination of the actual charging period of each of the Gate ICs may refer to the related descriptions in the first and second embodiments, which are not described herein again), and then the setting turning-on sequence number of each of the scan lines controlled by each of the Gate ICs turned on before the current Gate IC is determined. Then, each of the precharging periods of the scan line with the same setting turning-on sequence number in the current Gate IC is determined based on the actual charging periods corresponding to the scan lines with the same turning-on sequence number.

FIG. 5C is a schematic diagram of pixel charging in the third embodiment of the present disclosure. Specifically, each of the actual charging periods to be processed with the same setting turning-on number may be taken as the precharging period of the scan line with the same setting turning-on sequence number in the current Gate IC. For example, each of the Gate ICs controls three of the scan lines, and the current Gate IC is the third one to be turned on, then an actual charging period of the scan line with the second setting turning-on number in the first Gate IC, and an actual charging period of the scan line with the second setting turning-on number in the second Gate IC are taken as the precharging period of the scan line with the second setting turning-on number in the current Gate IC.

Or, the precharging duration of the target scan line with the same setting turning-on sequence number in the current Gate IC is determined based on each of the actual charging period to be processed with the same setting turning-on sequence number;

A starting time point of the actual charging period corresponding to the target scan line is determined;

A precharging period of the target scan line is determined based on the starting time point and the precharging duration, and the starting time point is an ending time point of the precharging period.

For example, each of the Gate ICs controls three of the scan lines, and the current Gate IC is the third one to be turned on, then an actual charging period of the scan line with the second setting turning-on number in the first Gate IC, and an actual charging period of the scan line with the second setting turning-on number in the second Gate IC are integrated into the precharging period of the scan line with the second setting turning-on number in the current Gate IC. The ending time point of the precharging period is the starting time point of the scan line.

In this way, the precharging period corresponding to each scan lines in the current Gate IC is determined, thereby precharging periods of the scan lines corresponding to all of the target Gate ICs are determined.

In the technical solution provided by the present embodiment, each of the target Gate ICs is sequentially taken as the current Gate IC by the display panel, and then the actual charging period of the scan line corresponding to each of the Gate ICs turned on before the current Gate IC is determined, so as to be taken as the actual charging period to be processed. Then each of the actual charging periods to be processed is taken as each of the precharging periods of the scan line corresponding to the current Gate IC, so that the pixels on each of the scan lines may get enough voltage to ensure the brightness uniformity of the display panel.

Figure 6:
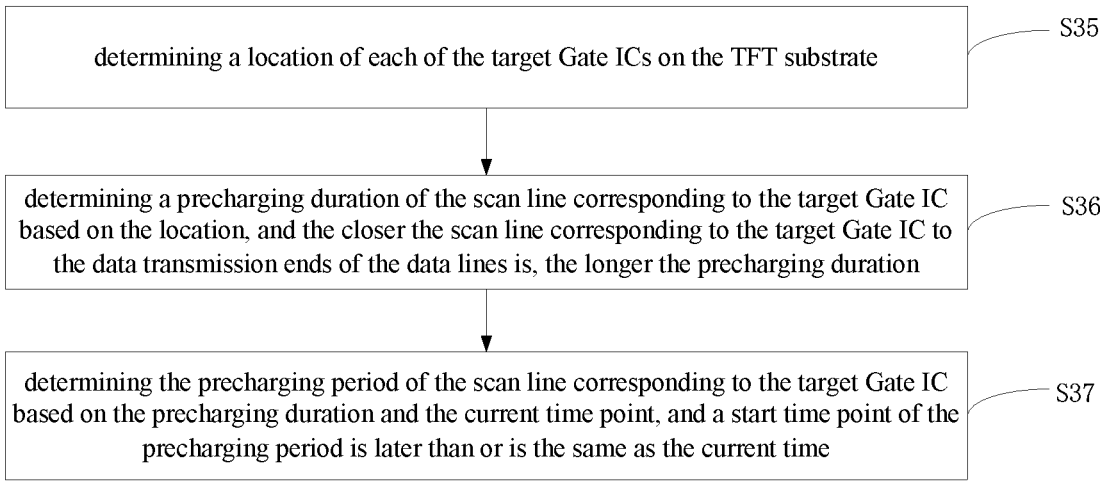
FIG. 6 is a schematic flow chart of the pixel charging method according to still another embodiment of the present disclosure.
Figure 7:
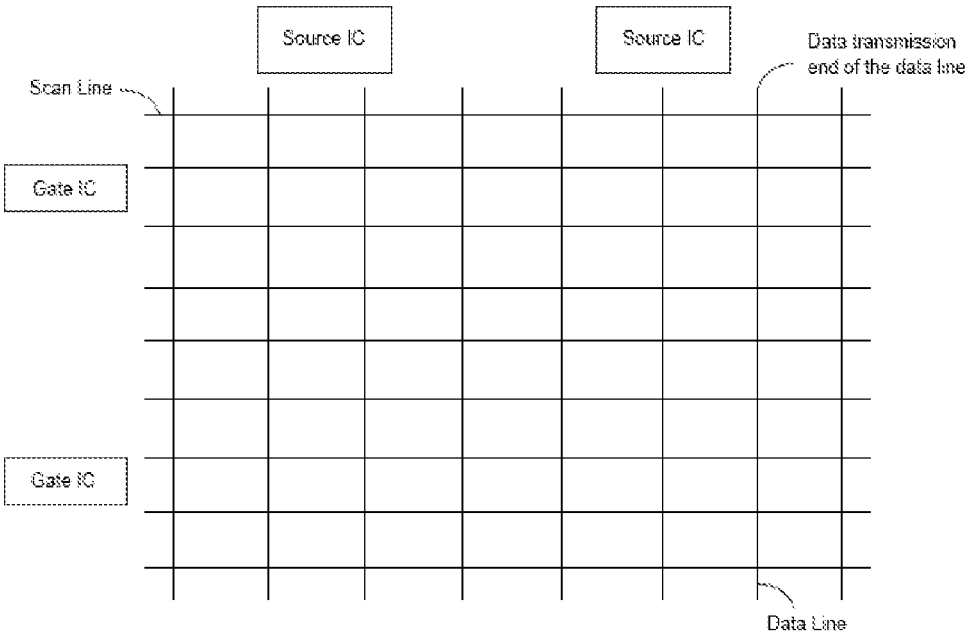
FIG. 7 is a schematic diagram showing an exemplary TFT substrate according to an embodiment of the present disclosure.

Referring to FIG. 6, FIG. 6 is still another embodiment of the pixel charging method of the present disclosure. According to an embodiment, the S30 includes:

S35, determining a location of each of the target Gate ICs on the TFT substrate;

S36, determining a precharging duration of the scan line corresponding to the target Gate IC based on the location, and the closer the scan line corresponding to the target Gate IC to the data transmission ends of the data lines is, the longer the precharging duration.

S37, determining the precharging period of the scan line corresponding to the target Gate IC based on the precharging duration and the current time point, and a start time point of the precharging period is later than or is the same as the current time;

In this embodiment, the display panel stores a mapping relationship between the position of each of the target Gate IC on the TFT and the precharging duration, and the closer the scan line corresponding to the target Gate IC to the data transmission ends of the data lines is, the longer the precharging duration is. Therefore, when the first Gate IC is turned on, the corresponding precharging duration may be determined based on the position of each of the target Gate IC on the TFT. Then the precharging period of the target Gate IC is determined based on the precharging duration and the current time point. A duration corresponding to the precharging period is the precharging duration, and a starting time point corresponding to the precharging period is later than or is the same as the current time point.

The precharging period of the scan line corresponding to the Gate IC is determined based on the position of the Gate IC on the TFT, which may save computational resources of the display panel.

The present disclosure further provides a display panel including at least one processor, and a memory device, and the memory device stores instructions executable by the at least one processor, and the at least one processor executes the instructions to perform the following operations:

acquiring a preset charging duration and a current time point when detecting that a first Gate IC on a TFT substrate is turned on, and the TFT substrate is provided with a plurality of horizontally arranged scan lines and a plurality of vertically arranged data lines, and taking a scan line having a maximum distance from data transmission ends of the data lines as a target scan line, and taking a Gate IC controlling the target scan line to be turned on as the first Gate IC;

determining an actual charging period of scan lines corresponding to each target Gate IC excluding the first Gate IC on the TFT substrate based on the preset charging duration and the current time point;

determining a precharging period of the scan lines corresponding to each of the target Gate ICs; and controlling TFT switches corresponding to the scan lines for each of the target Gate ICs to be turned on during the precharging period and the actual charging period, to charge pixels corresponding to the scan lines, and a voltage polarity of each pixel electrode corresponding to the data line on the TFT substrate is the same.

The present disclosure further provides a computer readable storage medium storing computer executable instructions executable by at least one processor, and the at least one processor executes the computer executable instructions to perform following operations:

acquiring a preset charging duration and a current time point when detecting that a first Gate IC on a TFT substrate is turned on, and the TFT substrate is provided with a plurality of horizontally arranged scan lines and a plurality of vertically arranged data lines, and taking a scan line having a maximum distance from data transmission ends of the data lines as a target scan line, and taking a Gate IC controlling the target scan line to be turned on as the first Gate IC;

determining an actual charging period of scan lines corresponding to each target Gate IC excluding the first Gate IC on the TFT substrate based on the preset charging duration and the current time point;

determining a precharging period of the scan line corresponding to each of the target Gate ICs; and controlling TFT switches corresponding to the scan lines for each of the target Gate ICs to be turned on during the precharging period and the actual charging period, to charge pixels corresponding to the scan lines, and a voltage polarity of each pixel electrode corresponding to the data line on the TFT substrate is the same.

The sequence numbers of the embodiments of the present disclosure are merely for the description, and do not represent the advantages and disadvantages of the embodiments.

Through the description of the above embodiments, those skilled in the art can clearly understand that the foregoing embodiment method can be implemented by means of software plus a necessary general hardware platform, and of course, can also be through hardware, but in many cases, the former is the better implementation. Based on such understanding, portions of the technical solution of the present disclosure that contribute substantially or to the exemplary techniques may be embodied in the form of a software product stored in a storage medium (such as a ROM/RAM, a disk, and an optical disk), including a number of instructions for causing a terminal device (which may be a mobile phone, a computer, a server, an air conditioner, or a network device, etc.) to perform the methods described in the various embodiments of the present disclosure.

The above descriptions are only alternative embodiments of the present disclosure, and is not intended to limit the scope of the disclosure of the present disclosure. All the equivalent structural transformation or equivalent process transformation made by the disclosure specification and the attached drawings under the idea of the disclosure, or directly/indirectly used in other relevant technical fields are included in the patent protection scope of the disclosure.

What is claimed is:

1. A pixel charging method, wherein the pixel charging method comprises:

acquiring a preset charging duration and a current time point when detecting that a first gate integrated circuit on a thin film transistor substrate is turned on, wherein the thin film transistor substrate is provided with a plurality of horizontally arranged scan lines and a plurality of vertically arranged data lines, taking a scan line having a maximum distance from data transmission ends of the data lines as a target scan line, taking a gate integrated circuit controlling the target scan line to be turned on as the first gate integrated circuit;

determining an actual charging period of scan lines corresponding to each target gate integrated circuit excluding the first gate integrated circuit on the thin film transistor substrate based on the preset charging duration and the current time point;

determining a precharging period of the scan line corresponding to each of the target gate integrated circuits; and controlling thin film transistor switches corresponding to the scan lines for each of the target gate integrated circuits to be turned on during the precharging period and the actual charging period, to charge pixels corresponding to the scan lines, wherein a voltage polarity of each pixel electrode corresponding to the data line on the thin film transistor substrate is the same;

wherein determining the precharging period of the scan line corresponding to each of the target gate integrated circuits comprises:

sequentially taking each of the target gate integrated circuits as a current gate integrated circuit, and determining a quantity of gate integrated circuits that are turned on before the current gate integrated circuit;

determining a precharging period of a scan line corresponding to the current gate integrated circuit based on the quantity of the gate integrated circuits turned on before the current gate integrated circuit, wherein the greater the quantity of the gate integrated circuits turned on before the current gate integrated circuit is, the greater a quantity of the precharging periods corresponding to the target gate integrated circuit.

2. The pixel charging method of claim 1, wherein a precharging duration of the precharging period is less than a charging duration of the actual charging period.

3. The pixel charging method of claim 1, wherein in the thin film transistor substrate, the closer the distance between the scan line corresponding to the gate integrated circuit and the data transmission ends of the data lines is, the longer a precharging duration of the pixels corresponding to the gate integrated circuit.

4. The pixel charging method of claim 1, wherein determining the actual charging period of the scan line corresponding to each of the target gate integrated circuits excluding the first gate integrated circuit on the thin film transistor substrate comprises:

determining an actual charging period of the scan line corresponding to the first gate integrated circuit based on the current time point and the preset charging duration;

determining the actual charging period of the scan line corresponding to each of the target gate integrated circuits based on the actual charging period of the scan line corresponding to the first gate integrated circuit, wherein actual charging periods of the scan lines corresponding to each of the integrated circuits on the thin film transistor substrate are sequential.

5. The pixel charging method of claim 1, wherein each of the gate integrated circuits on the thin film transistor substrate controls a plurality of the scan lines, and precharging durations of the plurality of scan lines controlled by the gate integrated circuit are the same.

6. The pixel charging method of claim 5, wherein the precharging duration is a delay duration corresponding to the thin film transistor switch with a maximum delay.

7. The pixel charging method of claim 1, wherein turning on each of the gate integrated circuits on the thin film transistor substrate is carried out in sequence from an opposite end of a source integrated circuit to the source integrated circuit end.

8. The pixel charging method of claim 1, wherein the preset charging duration is a setting charging duration of the pixels in the display panel.

9. The pixel charging method of claim 1, wherein the actual charging period is a setting charging period of the pixels in the display panel.

10. A display panel, wherein the display panel comprises at least one processor, and a memory device, wherein, the memory device stores instructions executable by the at least one processor, the at least one processor executing the instructions to perform the following operations:

acquiring a preset charging duration and a current time point when detecting that a first gate integrated circuit on a thin film transistor substrate is turned on, wherein the thin film transistor substrate is provided with a plurality of horizontally arranged scan lines and a plurality of vertically arranged data lines, taking a scan line having a maximum distance from data transmission ends of the data lines as a target scan line, taking a gate integrated circuit controlling the target scan line to be turned on as the first gate integrated circuit;

determining an actual charging period of the scan lines corresponding to the first gate integrated circuit based on the current time point and the preset charging duration;

determining the actual charging period of the scan lines corresponding to each of the target gate integrated circuits based on the actual charging period of the scan line corresponding to the first gate integrated circuit, wherein actual charging periods of the scan lines corresponding to each of the integrated circuits on the thin film transistor substrate are sequential;

determining a precharging period of the scan line corresponding to each of the target gate integrated circuits; and controlling thin film transistor switches corresponding to the scan lines for each of the target gate integrated circuits to be turned on during the precharging period and the actual charging period, to charge pixels corresponding to the scan lines, wherein a voltage polarity of each pixel electrode corresponding to the data line on the thin film transistor substrate is the same;

wherein determining the precharging period of the scan line corresponding to each of the target gate integrated circuits comprises:

sequentially taking each of the target gate integrated circuits as a current gate integrated circuit, and determining a quantity of gate integrated circuits that are turned on before the current gate integrated circuit;

determining a precharging period of a scan line corresponding to the current gate integrated circuit based on the quantity of the gate integrated circuits turned on before the current gate integrated circuit, wherein the greater the quantity of the gate integrated circuits turned on before the current gate integrated circuit is, the greater a quantity of the precharging periods corresponding to the target gate integrated circuit.

11. A non-transitory computer-readable storage medium, wherein the non-transitory computer-readable storage medium stores instructions executable by at least one processor, the at least one processor executing the instructions to perform the following operations:

acquiring a preset charging duration and a current time point when detecting that a first gate integrated circuit on a thin film transistor substrate is turned on, wherein the thin film transistor substrate is provided with a plurality of horizontally arranged scan lines and a plurality of vertically arranged data lines, taking a scan line having a maximum distance from data transmission ends of the data lines as a target scan line, taking a gate integrated circuit controlling the target scan line to be turned on as the first gate integrated circuit;

determining an actual charging period of scan lines corresponding to each target gate integrated circuit excluding the first gate integrated circuit on the thin film transistor substrate based on the preset charging duration and the current time point;

determining a precharging period of the scan line corresponding to each of the target gate integrated circuits; and controlling thin film transistor switches corresponding to the scan lines for each of the target gate integrated circuits to be turned on during the precharging period and the actual charging period, to charge pixels corresponding to the scan lines, wherein a voltage polarity of each pixel electrode corresponding to the data line on the thin film transistor substrate is the same;

wherein determining the precharging period of the scan line corresponding to each of the target gate integrated circuits comprises:

sequentially taking each of the target gate integrated circuits as a current gate integrated circuit, and determining a quantity of gate integrated circuits that are turned on before the current gate integrated circuit;

determining a precharging period of a scan line corresponding to the current gate integrated circuit based on the quantity of the gate integrated circuits turned on before the current gate integrated circuit, wherein the greater the quantity of the gate integrated circuits turned on before the current gate integrated circuit is, the greater a quantity of the precharging periods corresponding to the target gate integrated circuit.

* * * * *